US007227540B2

(12) United States Patent
Murayama et al.

(10) Patent No.: US 7,227,540 B2
(45) Date of Patent: Jun. 5, 2007

(54) IMAGE DISPLAY UNIT AND METHOD OF MANUFACTURING THE SAME

(75) Inventors: Jin Murayama, Miyagi (JP); Koichi Kimura, Kanagawa (JP); Shintaro Washizu, Shizuoka (JP); Fumitoshi Toyokawa, Miyagi (JP)

(73) Assignee: FUJIFILM Corporation, Tokyo (JP)

( * ) Notice: Subject to any disclaimer, the term of this patent is extended or adjusted under 35 U.S.C. 154(b) by 390 days.

(21) Appl. No.: 10/421,945

(22) Filed: Apr. 24, 2003

(65) Prior Publication Data

US 2003/0218603 A1 Nov. 27, 2003

(30) Foreign Application Priority Data

Apr. 25, 2002 (JP) ..... P. 2002-124536
Apr. 25, 2002 (JP) ..... P. 2002-124537

(51) Int. Cl.
*G09G 5/00* (2006.01)

(52) U.S. Cl. ..... 345/204; 345/206; 345/207; 345/212

(58) Field of Classification Search ..... 345/204–215, 345/84–87; 349/193–212

See application file for complete search history.

(56) References Cited

U.S. PATENT DOCUMENTS

| | | | | |
|---|---|---|---|---|
| 5,182,665 | A * | 1/1993 | O'Callaghan et al. | 349/201 |
| 5,451,977 | A * | 9/1995 | Kusuda et al. | 345/44 |
| 5,552,916 | A * | 9/1996 | O'Callaghan et al. | 349/201 |
| 6,998,644 | B1 * | 2/2006 | Boling et al. | 257/88 |
| 2002/0021479 | A1 * | 2/2002 | Scalora et al. | 359/241 |
| 2002/0054424 | A1 * | 5/2002 | Miles | 359/291 |
| 2002/0070931 | A1 * | 6/2002 | Ishikawa | 345/204 |
| 2003/0043157 | A1 * | 3/2003 | Miles | 345/540 |

* cited by examiner

*Primary Examiner*—Vijay Shankar
(74) *Attorney, Agent, or Firm*—Sughrue Mion, PLLC

(57) ABSTRACT

An MEM unit according to the invention comprises an Si (silicon) substrate 1 having such a thickness as to transmit a visible light therethrough, an insulating layer 2 formed in contact with the upper surface of the Si substrate 1, a lower electrode layer 3 formed in contact with the upper surface of the insulating layer 2, a sacrificial layer gap 4 of a space formed in the partial region of the upper surface of the lower electrode layer 3, a movable film 5 formed on the upper surface of the lower electrode layer 3 to cover the sacrificial layer gap 4, an upper electrode 6 formed in contact with the upper part of the movable film 5, a contact hole 7 penetrating to reach the surface of the lower electrode layer 3 from the surface of the movable film 5, and a lower electrode 8 formed from the surroundings of the upper part of the contact hole 7 to the surface of the lower electrode layer 3 through the contact hole 7.

13 Claims, 5 Drawing Sheets

FIG. 1

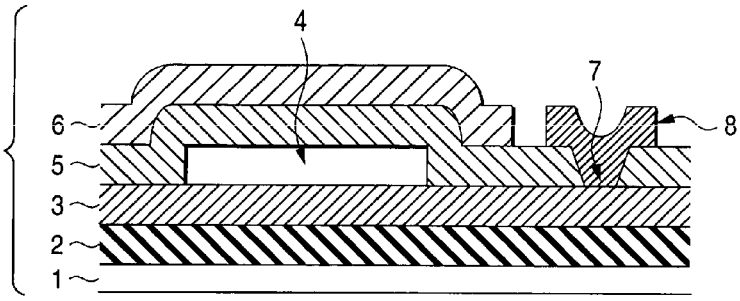

FIG. 2

| COMBINATION NUMBER | INSULATING LAYER 2 | LOWER ELECTRODE LAYER 3 | SACRIFICIAL LAYER 41 | MOVABLE FILM 5 | UPPER ELECTRODE LAYER 6 |
|---|---|---|---|---|---|
| 1 | $SiO_2$ | PolySi | Al | SiN | ITO |
| 2 | $SiO_2$ | W | Al | SiN | ITO |
| 3 | $SiO_2$ | PolySi | Al | $SiO_2$ | ITO |
| 4 | $SiO_2$ | W | Al | $SiO_2$ | ITO |
| 5 | $SiO_2$ | PolySi | Al | PI | ITO |
| 6 | $SiO_2$ | W | Al | PI | ITO |
| 7 | $SiO_2$ | PolySi | METAL | SiN | ITO |
| 8 | $SiO_2$ | W | METAL | SiN | ITO |
| 9 | $SiO_2$ | PolySi | METAL | $SiO_2$ | ITO |
| 10 | $SiO_2$ | W | METAL | $SiO_2$ | ITO |
| 11 | $SiO_2$ | PolySi | METAL | PI | ITO |
| 12 | $SiO_2$ | W | METAL | PI | ITO |

IMAGE DISPLAY UNIT AND METHOD OF MANUFACTURING THE SAME

BACKGROUND OF THE INVENTION

1. Field of the Invention

The present invention relates to an image display unit and a method of manufacturing the image display unit, and more particularly to an image display unit for functioning as a transmission type MEM (Mechanical Electro Modulator) unit and a method of manufacturing the image display unit.

2. Description of the Related Art

There have conventionally been proposed various image display units, and a CRT (cathode ray tube) display device, an LCD (liquid crystal display) device, an LED (light emitting diode) display device and a plasma display device have been used practically for a device using a typical image display unit.

In particular, an LCOS (Liquid Crystal on Si) has been well known as a reflection type image display device and has been used as a reflection type liquid crystal projector or a small-sized image display unit.

In recent years, moreover, an MEM unit has been proposed as the image display unit. The MEM unit is an electromechanical optical modulator for mechanically operating a flexible thin film fabricated on a glass substrate or a plastic film through a micromachining technique by electrostatic force, thereby carrying out optical modulation, and has conventionally been known as a transmission type display unit.

In more detail, for example, a flexible thin film comprising a transparent electrode and a diaphragm is provided on a fixed electrode over a light source through a support section as an optical modulator.

In the optical modulator, a predetermined voltage is applied between both of the electrodes to generate electrostatic force therebetween, thereby flexing the flexible thin film toward the fixed electrode. Correspondingly, the optical characteristic of the unit itself is changed so that a light is transmitted through the optical modulator. On the other hand, a voltage to be applied is set to be zero so that the flexible thin film is elastically returned and the optical modulator shields a light. Thus, the optical modulation is carried out.

FIG. 6 is a sectional view showing the internal structure of such a type as to utilize an interference which is one of the conventional MEM units.

In the MEM unit shown in FIG. 6, two upper and lower transparent electrodes 94 are formed with a spacing on the upper surface of a glass substrate 91 and two upper and lower half mirrors 92 are provided on the lower transparent electrode 94 through two spacers 95. A transparent spacer 93 formed of an insulator is formed in contact with the lower half mirror 92 in a space interposed between the two half mirrors 92 and the two spacers 95. The upper transparent electrode 94 is formed on the upper half mirror 92.

In the MEM unit shown in FIG. 6, a voltage is not applied between the two upper and lower transparent electrodes 94. Therefore, the upper half mirror 92 does not come in close contact with the transparent spacer 93 but is maintained to be formed. As a result, a light 97 emitted from a collimate plane light source 96 provided below the glass substrate 91 is reflected by the lower half mirror 92 and is not transmitted through an MEM unit body.

FIG. 7 is a sectional view showing an internal state obtained in the case in which a voltage is applied between the two upper and lower transparent electrodes in the MEM unit illustrated in FIG. 5.

In the MEM unit shown in FIG. 7, a voltage is applied between the two upper and lower transparent electrodes 94 of the MEM unit shown in FIG. 6. As a result, electrostatic force generated by the applied voltage acts between the transparent electrodes 94 and the upper transparent electrode 94 and the upper half mirror 92 provided thereunder are pushed downward so that the upper half mirror 92 comes in close contact with the transparent spacer 93 to increase the transmittance of a light in an optical path which is orthogonal to the two upper and lower half mirrors 92. Consequently, the light 97 emitted from the collimate plane light source 96 is transmitted through the MEM unit body and is properly scattered by a glass substrate 98 provided above the MEM unit body.

Display devices using the conventional image display unit have problems, respectively.

For example, it is hard to reduce the size of a CRT display device. In a display device having a very small size, there is a problem in that it is difficult to uniformly enhance a lifetime and a reliability and power consumption is also increased.

Moreover, an LCD display device requiring a back light has a problem of the use efficiency of the light. Furthermore, there is a problem in that a TFT (a thin film transistor) requiring a high cost is necessary.

In addition, an LED display device has a problem of the price and lifetime of a light emitting diode, particularly, a blue light emitting diode, and furthermore, a manufacturing cost of a two-dimensional array of the LED.

Moreover, a plasma display device has such an essential problem that a circuit integrating the control system of an image signal and the control system of a power supply required for fluorescent light emission is necessary. For this reason, there is a problem in that the control system of the image signal becomes huge and an operating speed cannot be increased.

Since the MEM unit to be one of the conventional image display units is formed on a glass substrate or a plastic film, there has been a problem in that a special machining technique is to be introduced and the degree of integration cannot be enhanced.

Furthermore, there is a problem in that an image signal is to be converted and processed into a suitable signal configuration for the MEM unit and a semiconductor circuit for driving is to be provided and connected as a separate device from the MEM unit and they cannot be integrated.

SUMMARY OF THE INVENTION

In consideration of the problems of the conventional image display unit and the method of manufacturing the image display unit described above, it is an object of the invention to provide an image display unit which uses semiconductor manufacturing equipment, has a small size and a high integration density, requires a low manufacturing cost and functions as a transmission type MEM unit.

Moreover, it is another object of the invention to provide a method of manufacturing an image display unit which uses semiconductor manufacturing equipment, has a small size and a high integration density, requires a low manufacturing cost and functions as a transmission type MEM unit.

In order to attain the object, a first aspect of the invention is directed to an image display unit to function as a transmission type mechanical electro modulator having two upper and lower electrode layers formed apart from each other and serving to change a transmittance of a light irradiated in an orthogonal direction to a horizontal direction of a body by applying a voltage between the two electrode layers, wherein the body including the two electrode layers in a component is formed on a silicon substrate having a predetermined transmittance for a visible light.

Moreover, a second aspect of the invention is directed to the image display unit according to the first aspect of the invention, wherein the silicon substrate has a predetermined transmittance for at least a part of a visible light having a wavelength of 400 to 650 nm.

Furthermore, a third aspect of the invention is directed to the image display unit according to the second aspect of the invention, wherein an insulating layer is provided between the silicon substrate and a lower one of the two electrode layers, a movable film is provided between the two electrode layers, and a gap portion covered with the movable film is provided on the lower electrode layer.

Moreover, a fourth aspect of the invention is directed to the image display unit according to the third aspect of the invention, wherein a contact hole penetrating to reach a surface of the lower electrode layer from a surface of an end provided apart from an upper part of the gap portion of the movable film is formed on the surface.

Furthermore, a fifth aspect of the invention is directed to the image display unit according to the fourth aspect of the invention, further comprising a lower electrode reaching the surface of the lower electrode layer through an inside of the contact hole and having an electrical contact with the electrode layer.

Moreover, a sixth aspect of the invention is directed to the image display unit according to any of the first to fifth aspects of the invention, wherein a semiconductor circuit for supplying a driving voltage to be applied to the two electrodes is formed on the silicon substrate.

Furthermore, a seventh aspect of the invention is directed to the image display unit according to the sixth aspect of the invention, wherein an image signal processing semiconductor circuit for controlling the driving voltage is formed on the silicon substrate.

Moreover, eighth to twelfth aspects of the invention are directed to a mechanical electro modulator manufacturing method of manufacturing the mechanical electro modulator according to the first to fifth aspects of the invention.

More specifically, in the invention, the silicon substrate is used in place of a conventional glass substrate or plastic film on which the main part of an MEM unit is to be formed, the main part of the MEM unit is formed on the silicon substrate and the bottom face of the silicon substrate is then scraped until the silicon substrate transmits a visible light at a predetermined transmittance. Consequently, it is possible to manufacture a transmission type MEM unit by using a method of manufacturing a semiconductor device. Thus, the transmission type MEM unit which is microfabricated to increase the degree of integration can be manufactured at a low cost without using a special technique such as a micromachining technique.

Moreover, it is possible to form, on the silicon substrate, another semiconductor circuit related to the manufactured MEM unit simultaneously and integrally.

Further, a thirteenth aspect of the invention is directed to an image display unit to function as a reflection type mechanical electro modulator having two upper and lower electrode layers formed apart from each other and serving to change a reflectance of a light irradiated in an orthogonal direction to a horizontal direction of a body by applying a voltage between the two electrode layers, wherein the body including the two electrode layers in a component is formed on a silicon substrate.

Moreover, a fourteenth aspect of the invention is directed to the image display unit, wherein an insulating layer is provided between the silicon substrate and a lower one of the two electrode layers, a movable film is provided between the two electrode layers, and a gap portion covered with the movable film is provided on the lower electrode layer.

Furthermore, a fifteenth aspect of the invention is directed to the image display unit, wherein a contact hole penetrating to reach a surface of the lower electrode layer from a surface of an end provided apart from an upper part of the gap portion of the movable film is formed on the surface.

Moreover, a sixteenth aspect of the invention is directed to the image display unit, further comprising a lower electrode reaching the surface of the lower electrode layer through an inside of the contact hole and having an electrical contact with the electrode layer.

Furthermore, a seventeenth aspect of the invention is directed to the image display unit, wherein a silicon substrate having a lower electrode layer formed by injecting a substance to increase a conductivity of silicon into an upper surface layer is used in place of the silicon substrate, the insulating layer and the lower electrode layer.

Moreover, a eighteenth aspect of the invention is directed to the image display unit, wherein a semiconductor circuit for supplying a driving voltage to be applied to the two electrodes is formed on the silicon substrate.

Furthermore, a nineteenth aspect of the invention is directed to the image display unit, wherein an image signal processing semiconductor circuit for controlling the driving voltage is formed on the silicon substrate.

Moreover, eighteenth aspect of the invention is directed to a mechanical electro modulator manufacturing method of manufacturing the mechanical electro modulator.

BRIEF DESCRIPTION OF THE DRAWINGS

FIG. 1 is a sectional view showing the internal structure of an image display unit according to an embodiment of the invention, FIG. 2 is a table showing a typical combination of material compositions for forming the component of the image display unit according to the embodiment of the invention, FIGS. 3(*a*) to 3(*c*) show the sectional views for each step showing an internal structure in each step for the image display unit according to the embodiment of the invention.

DESCRIPTION OF THE PREFERRED EMBODIMENTS

Figure 3:
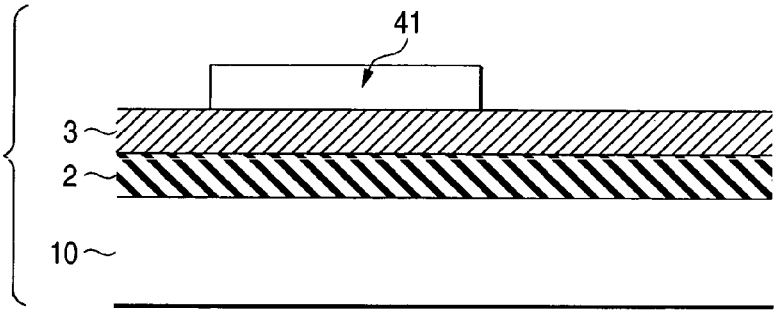
Figure 3:
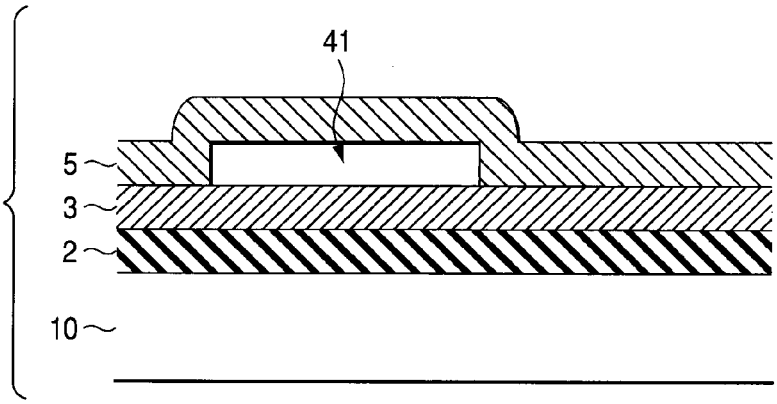
Figure 3:
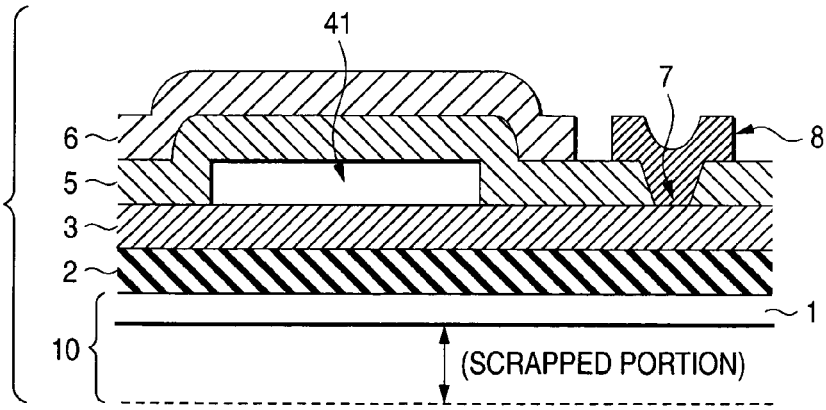

A preferred embodiment of the invention will be described below with reference to the drawings.

FIG. 1 is a sectional view showing the internal structure of an image display unit according to an embodiment of the invention.

The image display unit according to the embodiment shown in FIG. 1 comprises an Si (silicon) substrate 1 having such a thickness as to transmit a visible light therethrough, an insulating layer 2 formed in contact with the upper surface of the Si substrate 1, a lower electrode layer 3 formed in contact with the upper surface of the insulating layer 2, a sacrificial layer gap 4 of a space formed in the partial region of the upper surface of the lower electrode layer 3, a movable film 5 formed on the upper surface of the lower electrode layer 3 to cover the sacrificial layer gap 4, an upper electrode layer 6 formed in contact with the upper part of the movable film 5, a contact hole 7 penetrating to reach the surface of the lower electrode layer 3 from the surface of the movable film 5 provided apart from the sacrificial layer gap 4, and a lower electrode 8 formed from the surroundings of the upper part of the contact hole 7 to the surface of the lower electrode layer 3 through the contact hole 7.

FIG. 2 is a table showing a typical combination of material compositions for forming the component of the image display unit according to the embodiment of the invention.

In the table shown in FIG. 2, as a possible combination of materials, silicon dioxide ($SiO_2$) to be the insulating layer 2, polysilicon (PolySi) to be the lower electrode layer 3, aluminum (Al) to be the sacrificial layer 41, silicon nitride (SiN) to be the movable film 5 and ITO (Indium Tin Oxide) to be the upper electrode layer 6 are shown in an example of a combination having a combination number 1.

The lower electrode 8 can have the same material composition as that of the upper electrode layer 6.

In the table shown in FIG. 2, W represents tungsten, metal represents an optional metal and PI represents polyimide (Poly-imid).

It is assumed that each of the components has such a thickness as to transmit a visible light at a predetermined transmittance. It is preferable that the predetermined transmittance should be as technically high as possible.

In the table shown in FIG. 2, moreover, it is also possible to use a phosphorus silicate glass (PSG), a boron silicate glass (BSG), a boron-phosphorus silicate glass (BPSG) or their complex substance in place of $SiO_2$ to be the insulating layer 2 and the movable film 5. Similarly, it is also possible to use molybdenum (Mo), gold (Au), palladium (Pd), platinum (Pt) or their alloy in addition to tungsten to be the lower electrode layer 3. Moreover, an optional metal includes Al, Mo and W, for example. It is necessary to select different kinds of materials from the lower electrode layer 3. Furthermore, tin oxide ($SnO_2$) as well as the ITO can also be used for the upper electrode layer 6.

Next, description will be given to a process for manufacturing the image display unit according to the embodiment.

FIG. 3 is a sectional view for each step showing an internal structure in each step for the image display unit according to the embodiment of the invention.

First of all, at a step shown in FIG. 3(*a*), the insulating layer 2 is formed on the upper surface of the same Si substrate 10 as that used in the manufacture of a semiconductor device. It is possible to form the insulating layer 2 on the upper surface of the Si substrate 10 by using a general thermal oxidation method or CVD method in a semiconductor manufacturing process or a high density plasma CVD method such as ICP plasma CVD. Moreover, it is also possible to form the insulating layer 2 by a simple coating method.

Next, the lower electrode layer 3 is formed on the surface of the insulating layer 2. At this time, it is possible to form the lower electrode layer 3 on the surface of the insulating layer 2 by using a sputtering method.

In the case in which PolySi is to be formed as the lower electrode layer, it is possible to use a CVD method to be a general method in the semiconductor manufacturing process. In the case in which the surface of the lower electrode layer 3 is to have a plane figure taking a specific shape, moreover, patterning can be carried out by photolithography and etching in a semiconductor manufacturing technique.

Then, the sacrificial layer 41 to be removed at a subsequent step is formed in the predetermined surface region of the lower electrode layer 3. At this time, the plane pattern of the sacrificial layer 41 can be formed by photolithography and etching or may be formed by mask evaporation using a mask which is previously adapted to a planar shape. Thus, the sacrificial layer 41 having an optional figure can be formed in the predetermined surface region of the lower electrode layer 3.

At a step shown in FIG. 3(*b*), next, the movable film 5 for covering the lower electrode layer 3 and the sacrificial layer 41 which are formed at the step shown in FIG. 3(*a*) is provided. At this time, it is possible to form the movable film 5 for covering the lower electrode layer 3 and the sacrificial layer 41 by using a film forming method such as a CVD method. Moreover, it is also possible to form the movable film 5 by a simple coating method.

At a step shown in FIG. 3(*c*), first of all, the contact hole 7 is formed in a portion other than the sacrificial layer 41 region in the movable film 5 formed in FIG. 3(*b*) in order to maintain an electrical connection between the lower electrode layer 3 formed in FIG. 3(*a*) and the outside. The contact hole 7 can be formed by photolithography and etching. The upper electrode layer 6 is formed on the upper part of the surface of the movable film 5 formed at the step shown in FIG. 3(*b*) excluding a right end portion which does not overlap with the sacrificial layer 41 as shown. At this time, the right end portion is masked and the upper electrode layer 6 can be formed on the surface of the movable film 5 by using a sputtering method.

Then, ITO or $SnO_2$ is formed as the upper electrode layer 6 on the surface of the movable film 5. The upper electrode layer 6 can be formed on a front surface by a sputtering method or a coating method.

The upper electrode layer 6 thus formed is subjected to patterning at photolithography and etching steps after the formation. The patterning is carried out to form a pixel by interposing the sacrificial layer 41 and the movable film 5 between the lower electrode layer 3 and the upper electrode layer 6. At the same time, a wiring pattern is also formed in such a manner that the upper electrode layer 6 can be electrically connected to the outside.

At time of the patterning of the upper electrode layer 6, moreover, the lower electrode 8 is simultaneously formed in such a manner that an electrical connection from the formed contact hole 7 to the outside can be carried out, and furthermore, a wiring region is caused to remain. A different layer from the upper electrode layer 6 can also be used for a conductive layer to be utilized in the formation of the lower electrode 8 and a wiring from the lower electrode 8 to the outside.

Next, the sacrificial layer 41 formed under the movable film 5 at the step shown in FIG. 3(*a*) is removed to form the sacrificial layer gap 4. Thus, an image display unit comprising a movable section shown in FIG. 1 is finished. In this case, it is possible to use etching in order to remove the sacrificial layer 41.

Finally, the bottom face of the Si substrate 10 is subjected to the etching. Thus, a thin plate-shaped Si substrate 1 having a predetermined transmittance for a visible light is finished. The Si substrate 1 has such a thickness as to transmit a blue light (approximately 100 Å) of the visible light and to be as technically thin as possible. More specifically, it is preferable that the thickness should be 50A[μm] or less. Moreover, it is also possible to use CMP (Chemical Mechanical Polishing) in place of the etching.

Figure 4:
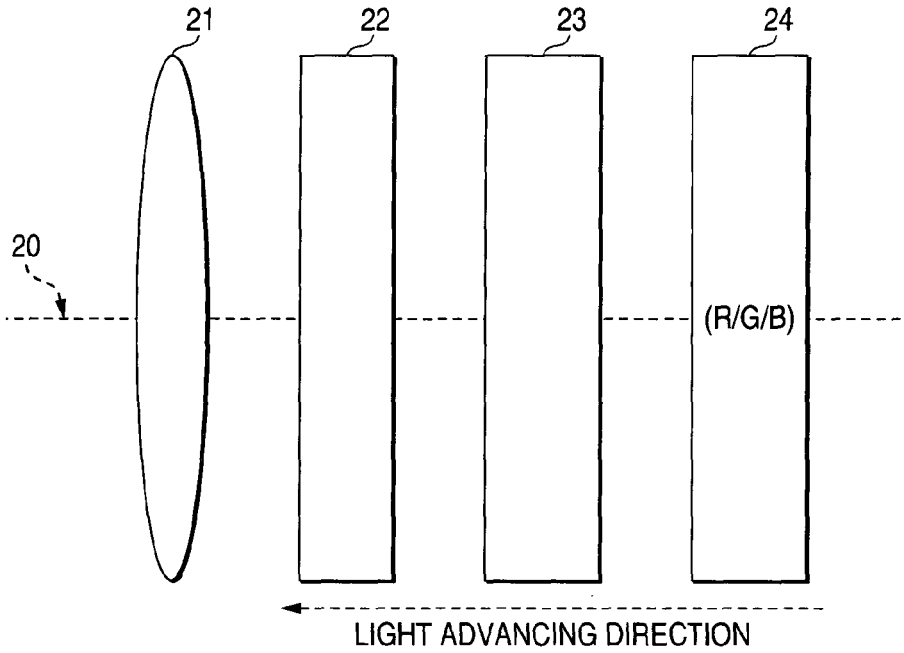
FIG. 4 is an explanatory view showing a specific example of use of the image display unit according to the embodiment of the invention.

FIG. 4 is an explanatory view showing a specific example of use of the image display unit according to the embodiment of the invention.

In the example of use shown in FIG. 4, an image element 22 to be an image display unit according to the embodiment of the invention is provided with a central point adapted to an optical axis 20 together with a diffusion layer 23 for obtaining a scattering light and an LED 24 (a liquid crystal unit) having three colors of R (red), G (green) and B (blue) to be a light source system.

Next, description will be given to the operation of the image display unit according to the embodiment.

Referring to the image display unit according to the embodiment shown in FIG. 1, a state in which a voltage is not applied between the upper electrode layer 6 and the lower electrode 8 (the state shown in FIG. 1) is compared with a state in which a voltage is applied between the upper electrode layer 6 and the lower electrode 8 (which is not shown). In the latter state in which the voltage is applied between the electrodes, suction force is generated between the electrodes by the action of electrostatic force so that the movable film 5 comes in close contact with the lower electrode layer 3 and the transmittance of a light irradiated in a vertical direction can be changed. As a result, when a voltage is applied between the electrodes in the image element 22 shown in FIG. 4 and the LED 24 provided on the back side of the image element 22 is turned ON, the light of the LED 24 is diffused by the diffusion layer 23 and is then projected onto the display side through the Si substrate 1. Accordingly, when the three colors of the LED 24 are sequentially turned ON with the driving control of the image element 22, a more colored display image can be obtained in order of R/G/B planes.

With the structure shown in FIG. 4, if a displayed image has a visible size, the image element 22 can directly be seen without the lens 21. Accordingly, the lens does not have a necessary structure in the image display unit. With the structure, while a color image is displayed, it is a matter of course that a monochrome image can also be obtained by using a white light source.

Although a single pixel has been described above, the invention is not restricted to the single pixel. Also in case of a one-dimensional array (on a line) and a two-dimensional array (plane), the same advantage can be obtained.

As described above, according to the embodiment, it is possible to manufacture a transmission type MEM unit by using the same step as the manufacture of a semiconductor device such as an FET (an electric field control transistor) without using a special technique such as a micromachining technique.

According to the embodiment, moreover, a semiconductor circuit for driving the image display unit according to the embodiment shown in FIG. 1 and a semiconductor circuit for converting and transmitting a signal to be supplied to the image display unit can be formed simultaneously and integrally as an extension circuit of the image display unit or an accessory circuit on the same substrate as the Si substrate to be the component of the image display unit.

Figure 5:
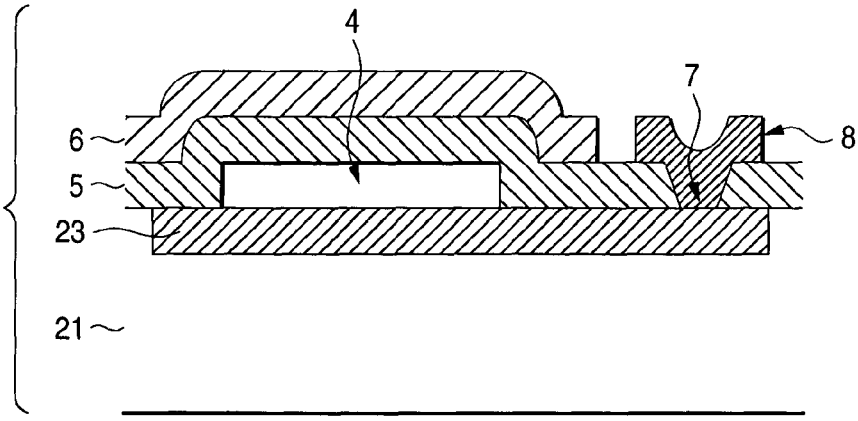
FIG. 5 is a sectional view showing another internal structure of the image display unit according to the embodiment of the invention, FIGS. 6(*a*) to 6(*c*) show the sectional views showing the internal structure of a conventional MEM unit, and FIGS. 7(*a*) to 7(*c*) show the sectional views showing an internal state obtained in the case in which a voltage is applied between two upper and lower transparent electrodes in the MEM unit illustrated in FIGS. 6(*a*) to 6(*c*).
Figure 6:
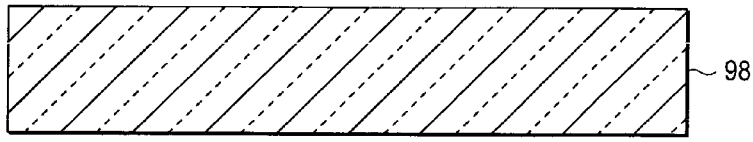
Figure 6:
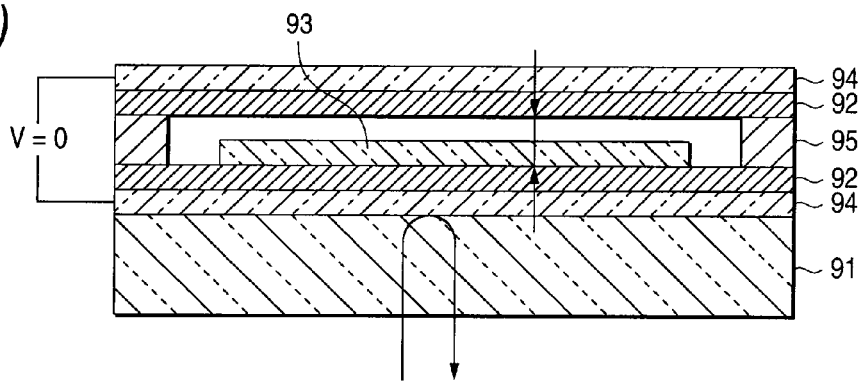
Figure 6:
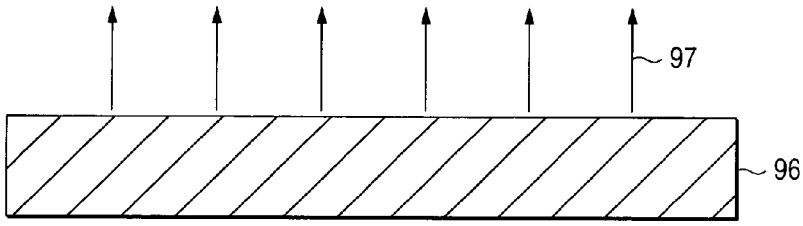
Figure 7:
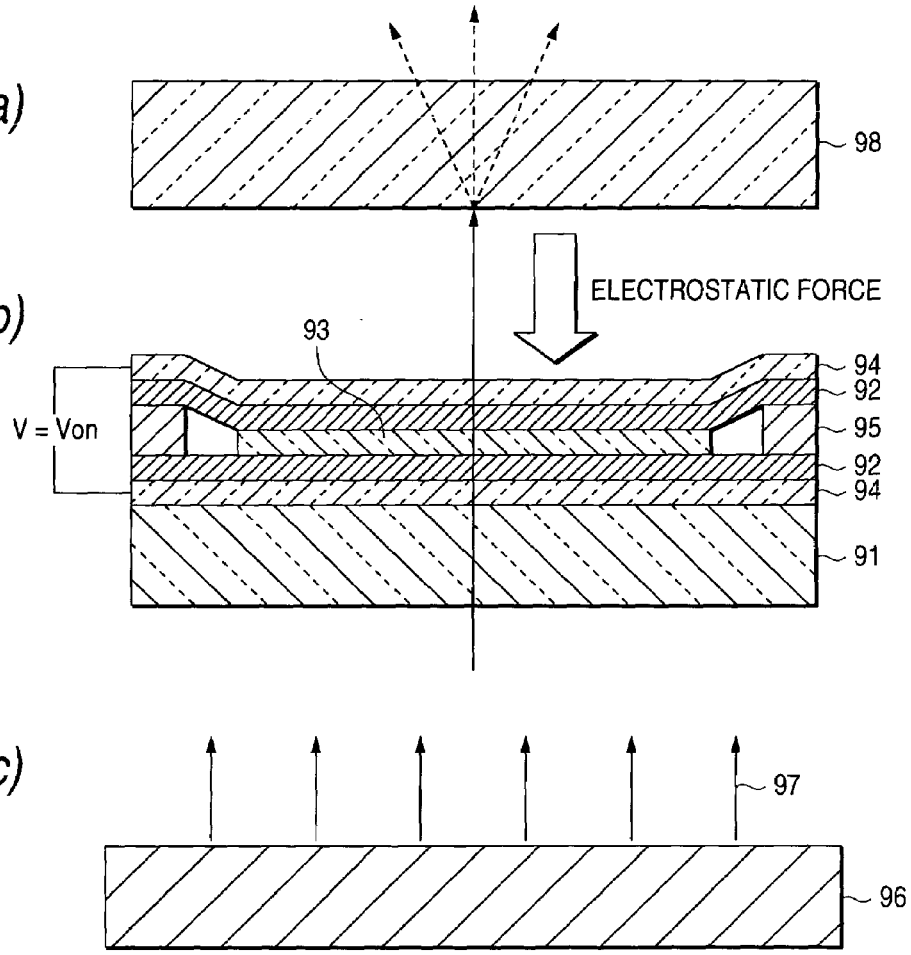

FIG. 5 is a sectional view showing another internal structure of the image display unit according to another embodiment of the invention.

The internal structure of the image display unit shown in FIG. 5 is the same as that of the image display unit shown in FIG. 1 except that the insulating layer 2 shown in FIG. 1 is not used differently from the internal structure of the image display unit shown in FIG. 1 and that the Si substrate 1 shown in FIG. 1 which is filled with a lower electrode layer 23 is used as an Si substrate 21.

The material composition of the lower electrode layer 23 is obtained by implanting a substance to increase the conductivity of silicon (for example, phosphorus (P) or boron (B)) into the silicon.

Moreover, the step of forming the lower electrode layer 23 is the same as the step of forming the source or drain of an FET (an electric field control transistor), and an ion implanting method or an impurity diffusing step can be used.

Next, description will be given to the operation of the image display unit according to the embodiment.

Referring to the image display units according to the embodiment shown in FIGS. 1 and 5, the reflectance of a light irradiated in a vertical direction is varied in a state in which a voltage is not applied between the upper electrode layer 6 and the lower electrode layer 8 (the state shown in FIG. 1) and a state in which a voltage is applied between the upper electrode layer 6 and the lower electrode 8. In other words, in such a state that the voltage is applied to cause the movable film 5 to come in contact with the lower electrode layers 3 and 23, a light emitted from a light source provided on the display side of the image display unit is reflected by the surface of the Si substrate 1 or the surface of the lower electrode layer 23.

As described above, according to the embodiment, it is possible to manufacture an MEM unit by using the same step as the manufacture of a semiconductor device such as an FET without using a special technique, for example, a micromachining technique.

According to the embodiment, moreover, a semiconductor circuit for driving the image display units according to the embodiment shown in FIGS. 1 and 5 and a semiconductor circuit for converting and transmitting a signal to be supplied to the image display unit can be formed as an extension circuit of the image display unit or an accessory circuit on the same substrate as the Si substrate 1 and the Si substrate 21 to be the components of the image display unit.

Although a single pixel has been described above, the invention is not restricted to the single pixel. Also in case of a one-dimensional array (on a line) and a two-dimensional array (plane), the same advantage can be obtained.

As described above, it is possible to reliably manufacture a microfabricated MEM unit of a transmission type which can increase the degree of integration at a low cost by using the same steps as the steps of manufacturing a semiconductor device such as an FET.

Moreover, a necessary semiconductor circuit for driving the image display unit and a semiconductor circuit for supplying a signal to the image display unit are formed on the same substrate as the substrate on which the image display unit is formed, and are integrated with the image display unit so that the manufacture can be carried out.

What is claimed is:

1. An image display unit to function as a transmission type mechanical electro modulator having two upper and lower electrode layers formed apart from each other and serving to change a transmittance of a light irradiated in an orthogonal direction to a horizontal direction of a body by applying a voltage between the two electrode layers, wherein the body including the two electrode layers in a component is formed on a silicon substrate of such a thickness as to have a predetermined transmittance for a visible light; and wherein an insulating layer is provided between the silicon substrate and the lower one of the two electrode layers, a movable film is provided between the two electrode layers, and a gap portion covered with the movable film is provided on the lower electrode layer.

2. The image display unit according to claim 1, wherein the silicon substrate has a predetermined transmittance for at least a part of a visible light having a wavelength of 400 to 650 nm.

3. The image display unit according to claim 1, wherein a contact hole penetrating to reach a surface of the lower electrode layer from a surface of an end provided apart from an upper part of the gap portion of the movable film is formed on the surface.

4. The image display unit according to claim 3, further comprising a lower electrode reaching the surface of the lower electrode layer through an inside of the contact hole and having an electrical contact with the electrode layer.

5. The image display unit according to claim 1, wherein a semiconductor circuit for supplying a driving voltage to be applied to the two electrodes is formed on the silicon substrate.

6. The image display unit according to claim 5, wherein an image signal processing semiconductor circuit for controlling the driving voltage is formed on the silicon substrate.

7. The image display unit according to claim 1, wherein the thickness of the silicon substrate is equal or less than 50 μm.

8. An image display unit to function as a reflection type mechanical electro modulator having two upper and lower electrode layers formed apart from each other and serving to change a reflectance of a light irradiated in an orthogonal direction to a horizontal direction of a body by applying a voltage between the two electrode layers, wherein the body including the two electrode layers in a component is formed on a silicon substrate, and wherein an insulating layer is provided between the silicon substrate and a lower one of the two electrode layers, a movable film is provided between the two electrode layers, and a gap portion covered with a movable film is provided on the lower electrode layer.

9. The image display unit according to claim 8, wherein a contact hole penetrating to reach a surface of the lower electrode layer from a surface of an end provided apart from an upper part of the gap portion of the movable film is formed on the surface.

10. The image display unit according to claim 9, further comprising a lower electrode reaching the surface of the lower electrode layer through an inside of the contact hole and having an electrical contact with the electrode layer.

11. The image display unit according to claim 8, wherein a silicon substrate having a lower electrode layer formed by injecting a substance to increase a conductivity of silicon into an upper surface layer is used in place of the silicon substrate, the insulating layer and the lower electrode layer.

12. The image display unit according to claim 8, wherein a semiconductor circuit for supplying a driving voltage to be applied to the two electrodes is formed on the silicon substrate.

13. The image display unit according to claim 12, wherein an image signal processing semiconductor circuit for controlling the driving voltage is formed on the silicon substrate.

* * * * *